US010151073B2

(12) United States Patent
Stoddart

(10) Patent No.: US 10,151,073 B2
(45) Date of Patent: Dec. 11, 2018

(54) SNOW REMOVAL DEVICE COMPRISING A PUSHING ELEMENT WITH CONVEX END PORTIONS AND A SCRAPING FLANGE

(71) Applicant: David Lorne Stoddart, St. Anne (CA)

(72) Inventor: David Lorne Stoddart, St. Anne (CA)

( * ) Notice: Subject to any disclaimer, the term of this patent is extended or adjusted under 35 U.S.C. 154(b) by 3 days.

(21) Appl. No.: 14/979,024

(22) Filed: Dec. 22, 2015

(65) Prior Publication Data

US 2016/0222613 A1 Aug. 4, 2016

(30) Foreign Application Priority Data

Feb. 4, 2015 (CA) ..... 2881150

(51) Int. Cl.
*E01H 5/02* (2006.01)
*E01H 5/06* (2006.01)

(52) U.S. Cl.
CPC ..... *E01H 5/02* (2013.01); *E01H 5/061* (2013.01); *E01H 5/065* (2013.01)

(58) Field of Classification Search
CPC ..... E01H 5/02; E01H 5/061; E01H 5/065–5/068; E01H 5/12; A47L 13/02; A47L 13/022
USPC ..... 37/266, 272, 274, 278, 281, 284, 285
See application file for complete search history.

(56) References Cited

U.S. PATENT DOCUMENTS 323,730 A * 8/1885 Phillips ..... E01H 5/02 37/266
637,712 A * 11/1899 Damerell ..... A01B 19/08 172/240
771,603 A * 10/1904 Birch ..... E01H 5/068 37/268
1,511,073 A * 10/1924 Gampher ..... E01H 5/02 37/267
D214,636 S * 7/1969 Zahler ..... D8/10
3,473,838 A * 10/1969 Rankin ..... E01H 5/02 294/53.5
4,261,115 A * 4/1981 Chittenden ..... E01H 5/061 172/701.3

(Continued)

FOREIGN PATENT DOCUMENTS

CA 2881150 A1 * 8/2016 ..... E01H 5/02
DE 202013011067 U1 * 1/2014 ..... E01H 5/02

*Primary Examiner* — Thomas B Will
*Assistant Examiner* — Joan D Misa
(74) *Attorney, Agent, or Firm* — Ryan W. Dupuis; Ade & Company Inc.; Kyle R. Satterthwaite

(57) ABSTRACT

A snow removal device features a pushing element and handle. The pushing element has a main portion defining an upright plane with opposing front and rear surfaces and a bottom edge along the front surface. Laterally opposing end portions of the pushing element extend forwardly from the upright plane and have bottom edges. The bottom edges of the end portions adjacent the front surface are acute relative thereto so that the main portion is pivotal about its bottom edge from a normal working orientation in which the upright plane is substantially perpendicular to a flat surface along which the pushing element slides to a forward inclined orientation which is pivotally further forward of the normal working orientation without lifting the bottom edge of the main portion. The device further features a scraping flange extending rearwardly and downwardly from the rear surface.

10 Claims, 7 Drawing Sheets

(56) References Cited

U.S. PATENT DOCUMENTS

| | | | | | |
|---|---|---|---|---|---|
| 4,538,847 | A * | 9/1985 | Lapshansky | A01B 1/222 | 294/51 |
| 4,669,206 | A * | 6/1987 | Yost | E01H 5/02 | 294/54.5 |
| 4,707,936 | A * | 11/1987 | Steinhoff | E01H 5/065 | 37/264 |
| 4,709,492 | A * | 12/1987 | Watson | E01H 5/02 | 172/727 |
| 5,117,530 | A * | 6/1992 | Rank | E01H 5/02 | 15/245 |
| 5,493,797 | A * | 2/1996 | Jackson | E01H 5/066 | 37/284 |
| 5,791,707 | A * | 8/1998 | Szakurski | A01B 1/225 | 294/51 |
| 6,290,273 | B1 * | 9/2001 | Moisan | E01H 5/02 | 294/53.5 |
| 6,474,007 | B1 * | 11/2002 | Sueshige | B62B 1/20 | 180/19.3 |
| 6,612,050 | B2 * | 9/2003 | Takeuchi | E01H 5/061 | 37/232 |
| 7,562,473 | B2 * | 7/2009 | Westendorf | E02F 3/40 | 37/268 |
| 8,100,447 | B2 * | 1/2012 | DeWinter | A01B 1/02 | 294/51 |
| 8,347,528 | B1 * | 1/2013 | Seltzer | E01H 5/02 | 172/371 |
| D680,558 | S * | 4/2013 | Clement | D15/11 | |
| 9,109,336 | B1 * | 8/2015 | Firth | E01H 5/02 | |
| 2013/0199061 | A1 | 8/2013 | Klein | | |

* cited by examiner

SNOW REMOVAL DEVICE COMPRISING A PUSHING ELEMENT WITH CONVEX END PORTIONS AND A SCRAPING FLANGE

This application claims the benefit of Canadian Patent Application 2,881,150 filed Feb. 4, 2015.

FIELD OF THE INVENTION

The present invention relates generally to a snow removal device, and more particularly the present invention relates to a snow removal device having a pushing element with laterally opposing end portions which are convex and a scraping flange coupled to the pushing element.

BACKGROUND

A variety of different snow removal devices are offered for clearing snow from generally flat surfaces such as driveways, sidewalks, and the like. Effectiveness of snow shovels or pushers in clearing snow depends in part on maintaining contact between a bottom edge of a blade of the snow removal device and the flat surface. A common problem with many current designs is that when the bottom edge of the blade becomes caught on a rigid spot of snow, continued forward motion of a user sliding the snow removal device along the flat surface causes the blade to pivot forward about the rigid spot until the bottom edge lifts upward from the flat surface. Consequently, a portion of the snow on the flat surface, especially which is in a vicinity of the rigid spot, is not cleared in a continuous sliding movement of the pushing element along the flat surface.

U.S. Patent Application 2013/0199061 to Klein describes a snow removal device comprising a plow member, which is generally U-shaped in plan view, and a handle which is pivotally connected to the plow member. Pivotal connection of the handle to the plow member affords bottom edges of the plow member to maintain contact with the ground regardless of an angled position of the handle relative to the plow member; however, the prior art has one potential shortcoming. A non-rigid connection between the handle and plow does not allow for optimal transfer of horizontal force from the user to the plow member, and in instances when the plow member becomes caught on the rigid spot of snow, clearing the rigid spot requires careful application of force to accomplish the clearing of same.

Furthermore, rigid spots such icy patches or densely compacted patches of snow are difficult to remove by scraping them with the bottom edge of the plow member. For this reason, dedicated scraping tools are manufactured separately from snow shovels and pushers. As such, snow that is generally loose is cleared first; then, the ice or the compacted patches of snow are scraped from the surface.

The Applicant provides a unique solution for a snow removal device which may solve the forgoing potential shortcomings of the prior art.

SUMMARY OF THE INVENTION

According to one aspect of the invention there is provided a snow removal device for clearing snow from a generally flat surface in a sliding motion along the flat surface, the snow removal device comprising:

a pushing element which is elongate in a lateral direction, the pushing element having a main portion and laterally opposing end portions;

the main portion having opposing front and rear surfaces and opposing top and bottom edges along the front surface, the main portion substantially defining an upright plane in a normal working orientation;

the end portions extending forwardly from the upright plane and having bottom edges;

a handle extending rearwardly from the main portion;

wherein the bottom edges of the end portions extend upwardly from the bottom edge of the main portion so that the main portion is pivotal thereabout from the normal working orientation in which the upright plane is substantially perpendicular to the flat surface to a forward inclined orientation which is pivotally further forward relative to the normal working orientation without lifting the bottom edge of the main portion.

The embodiment according to the first aspect of the invention described in more detail hereinafter affords pivoting of the main portion about the bottom edge thereof without lifting same. As a user slides the pushing element oriented in the normal working orientation in a forwardly direction along the ground surface, the main portion has ability to pivot forward due to design of the end portions so that any rigid material on the flat surface does not impede a smooth sliding motion of the pushing element along the flat surface by causing the bottom edge of the main portion to lift from the surface. Furthermore, the handle is fixedly supported on the pushing element so that pressure of the bottom edge along the flat surface may be maintained or increased between the normal working orientation and the forward inclined orientation.

The upright plane may be defined by: (i) the top and bottom edges, such as when the main portion is curved concavely inward from the front surface toward the rear surface; (ii) a majority of the front surface, such as when the majority of the front surface is planar and an elongate portion of the front surface adjacent the bottom edge of the main portion is curved forwardly and downwardly from the majority of the front surface; or (iii) both the top and bottom edges and the majority of the front surface, such as when the front surface is planar in its entirety.

Preferably, the bottom edges of the end portions are curved upwardly and forwardly from the bottom edge of the main portion. Preferably, each one of the end portions forms an angle with the upright plane that is between 50 and 80 degrees.

Preferably, the end portions also extend laterally outward from the main portion at a forward and lateral incline.

It is preferred that the snow removal device further includes a scraping element extending rearwardly from the rear surface of the main portion, the scraping element having a scraping edge at a free end of the scraping element that is located at a spaced distance rearward of the rear surface of the main portion. Preferably, the scraping element also extends downwardly from the rear surface at a location spaced above the bottom edge of the main portion such that the scraping element is oriented at a decline from the rear surface. Preferably, the scraping element is elongate and spans horizontally along a substantial portion of the main portion of the pushing element. In one instance, the scraping element is a flange. The snow removal device preferably has a coupler arranged for coupling the pushing element and handle, the coupler comprising a bracket plate. When the snow removal device has the coupler, the scraping element is integral with the bracket plate.

Preferably, the main portion further comprises a bottom surface spanning between the front and rear surfaces such that the bottom and front surfaces collectively form the bottom edge of the main portion. When the main portion has the bottom surface, the bottom surface forms an acute angle with the front surface.

When the snow removal device includes the coupler, the coupler also has gusset plates on laterally opposing sides of the handle between the handle and the pushing element, the gusset plates extending rearwardly from the pushing element for strengthening the coupler.

Preferably, the handle comprises a plurality of telescopic elements which are elongate and arranged to be slidable relative to one another in a telescoping configuration for adjusting a length of the handle, and the handle is coupled to the pushing element such that the handle is removable therefrom for packaging when shipping.

According to a second aspect of the invention there is provided a snow removal device for clearing snow from a generally flat surface in a sliding motion along the flat surface, the snow removal device comprising:

a pushing element which is elongate in a lateral direction, the pushing element having a main portion and laterally opposing end portions;

the main portion having opposing front and rear surfaces and a bottom edge along the front surface;

the end portions extending forwardly from the main portion and having bottom edges;

a handle extending rearwardly from the main portion;

wherein at least a portion of each one of the bottom edges of the end portions is convex.

The embodiment according to the second aspect of the invention described in more detail hereinafter affords pivoting of the main portion about its bottom edge without lifting same because of design of the end portions.

When the front surface defines an upright plane, the bottom edges of the end portions comprise linear portions which are adjacent the front surface and intermediate the front surface and said portions of the bottom edges of the end portions that are convex, the linear portions of the bottom edges being acute relative to the upright plane. Preferably, the bottom edges of the end portions adjacent the front surface form an angle between 75 and 90 degrees.

According to a third aspect of the invention there is provided a snow removal device for clearing snow from a generally flat surface in a sliding motion along the flat surface, the snow removal device comprising:

a pushing element which is elongate in a lateral direction and has opposing front and rear surfaces;

the pushing element also having a bottom edge along the front surface;

a handle extending rearwardly from the main portion;

a scraping element extending rearwardly from the rear surface of the pushing element, the scraping element having a scraping edge at a free end of the scraping element that is at a spaced distance rearward of the rear surface of the main portion.

The embodiment according to the third aspect of the invention described in more detail hereinafter combines a pushing element and scraping element in one implement so as to afford ability to clear snow and subsequently remove rigid spots of snow from the flat surface by pivoting the pushing element rearwardly about its bottom edge so that the scraping element engages the flat surface in a scraping action thereof as the pushing element is slid rearwardly along the flat surface.

Preferably, the scraping element also extends downwardly from the rear surface at a location spaced above the bottom edge of the main portion such that the scraping element is oriented at a decline from the rear surface.

Preferably, the scraping element is elongate and spans horizontally along a substantial portion of the main portion of the pushing element.

Preferably, the scraping element is a flange.

Preferably, the snow removal device includes a coupler arranged for coupling the pushing element and handle, and the coupler has a bracket plate. When the snow removal device comprises the coupler, the scraping element is integral with the bracket plate.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
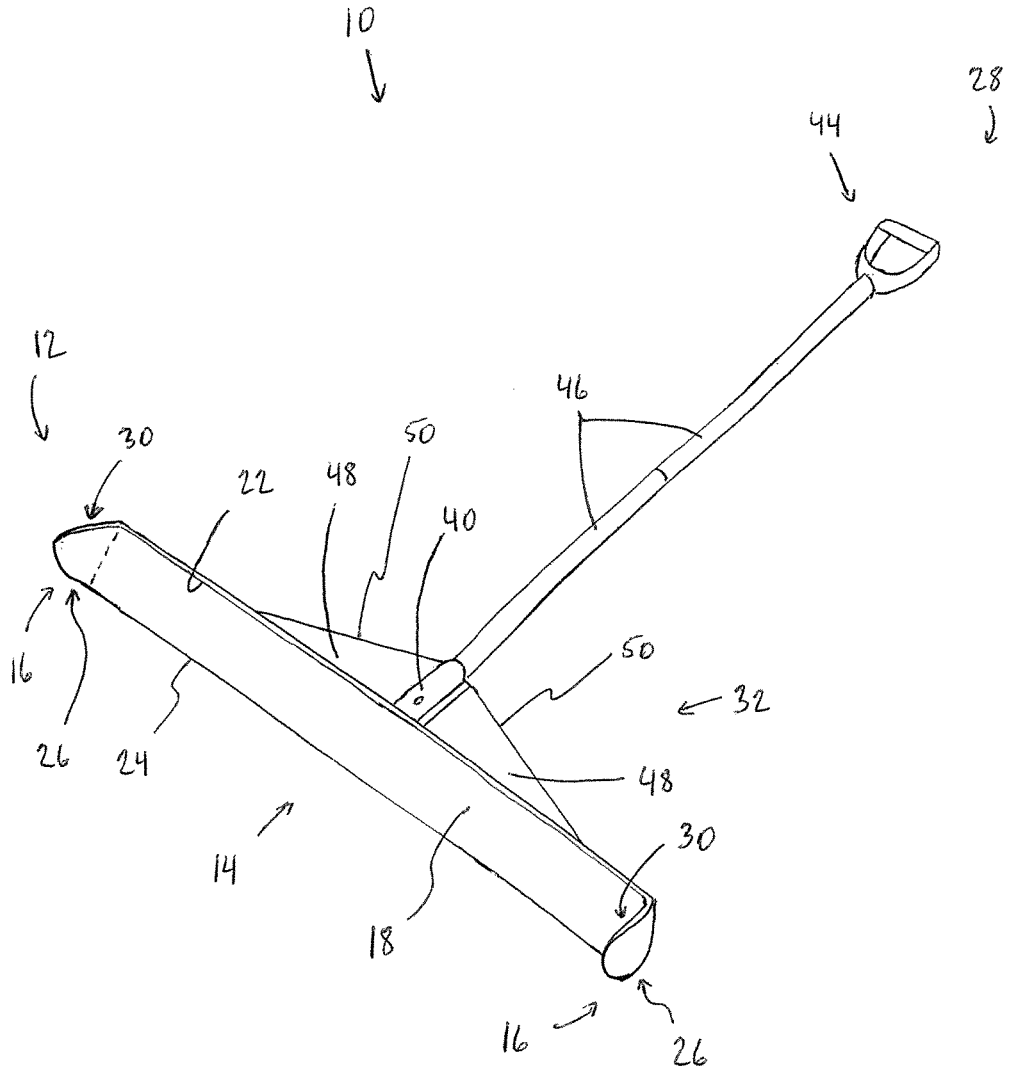
FIG. 1 is a front perspective view of the snow removal device.
Figure 2:
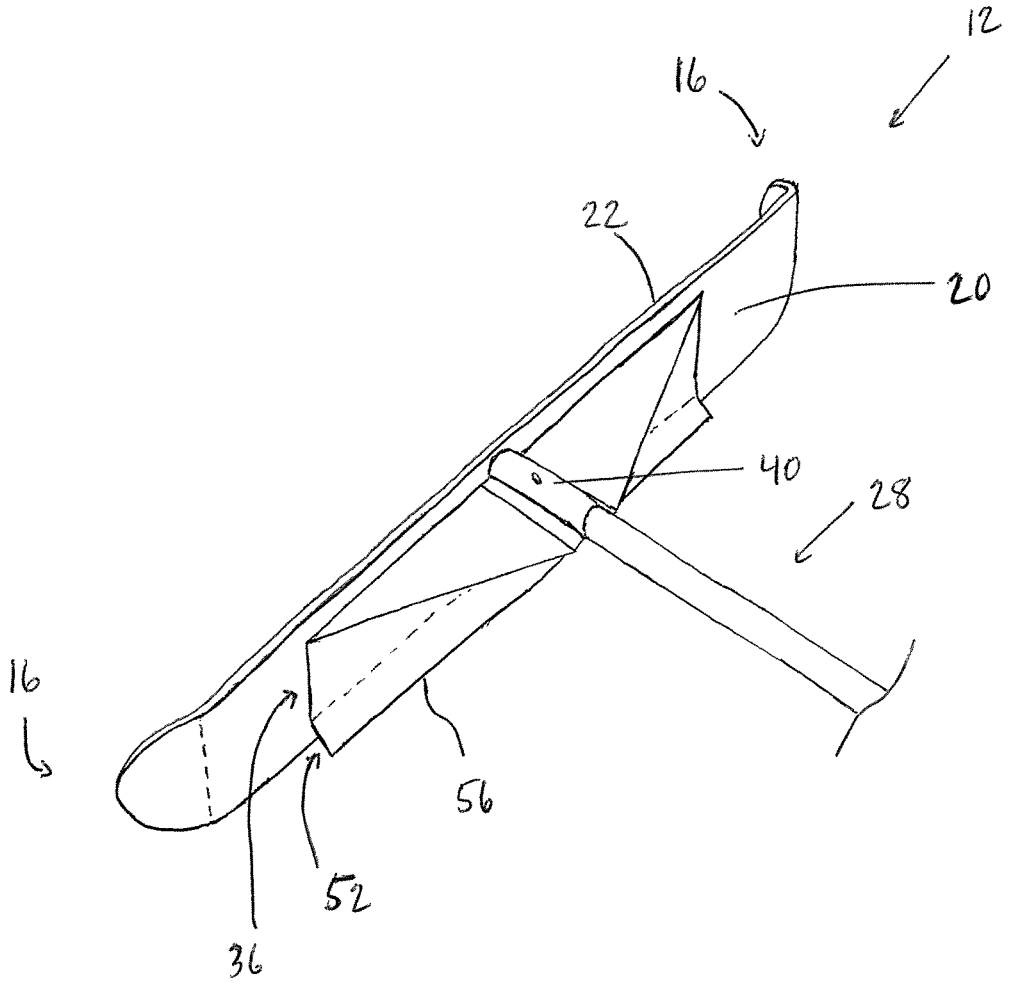
FIG. 2 is a rear perspective view of the snow removal device in FIG. 1.

Referring to the accompanying figures, there is illustrated a snow removal device generally indicated by reference numeral 10. The snow removal device is used for clearing snow from a generally flat surface 1 in a sliding motion along the flat surface.

The snow removal device comprises a pushing element 12. The pushing element is elongate in a lateral direction. The pushing element has a main portion 14 and laterally opposing end portions 16.

The main portion 14 comprises opposing front 18 and rear 20 surfaces. Further to the surfaces, the main portion includes opposing top 22 and bottom 24 edges along the front surface. The main portion substantially defines an upright plane in a normal working orientation shown more clearly in FIG. 5. The top and bottom edges of the main portion are hereinafter referred to as main top edge and main bottom edge, respectively.

The end portions 16 extend forwardly from the upright plane and have bottom edges 26 along a front surface of the end portions. The bottom edges of the end portions extend upwardly from the main bottom edge 24 so that the main portion is pivotal thereabout from the normal working orientation in which the upright plane is substantially perpendicular to the flat surface 1, which is more clearly shown in FIG. 5, to a forward inclined orientation in FIG. 6 which is pivotally further forward relative to the normal working orientation. As such, the main portion is pivotal from the normal working orientation to the forward inclined orientation without lifting the main bottom edge.

The snow removal device also has a handle 28 extending rearwardly from the main portion.

Turning now to the main portion in more detail, the main portion 14 spans laterally between the end portions 16 and uprightly between the main top 22 and bottom 24 edges. In the illustrated embodiment, the main portion is planar such that an entirety of the main portion lies in the upright plane defined by the main portion. The main portion is also substantially smooth. The main portion has a bottom surface 29, more clearly shown in FIG. 5, spanning between the front 18 and rear 20 surfaces such that the bottom and front surfaces collectively form the bottom edge 26 of the main portion. The bottom surface forms an acute angle with the front surface such that the main bottom edge is generally sharpened.

Figure 5:
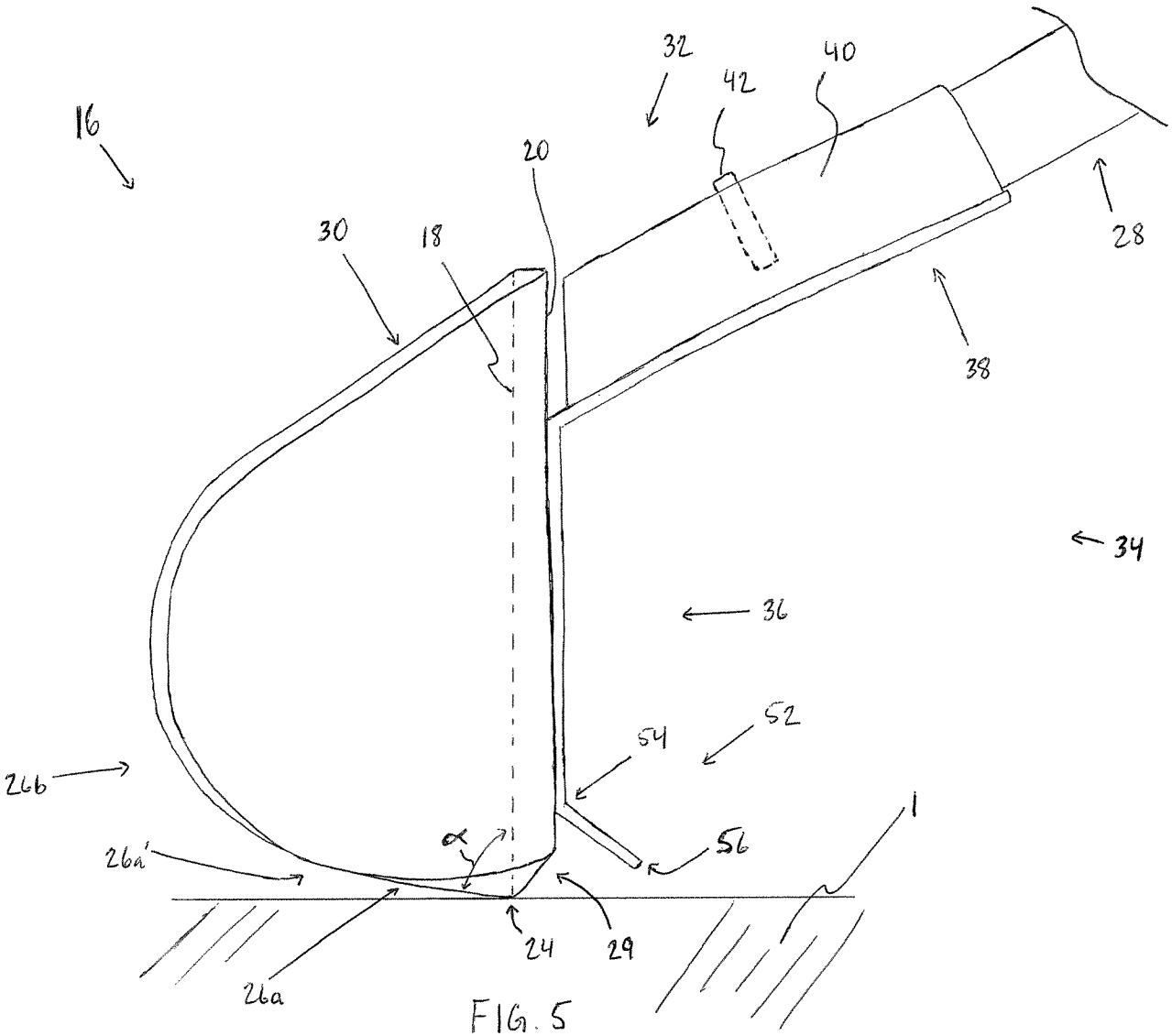
FIG. 5 is a side elevation view of the snow removal device in FIG. 1 in the normal working orientation.
Figure 6:
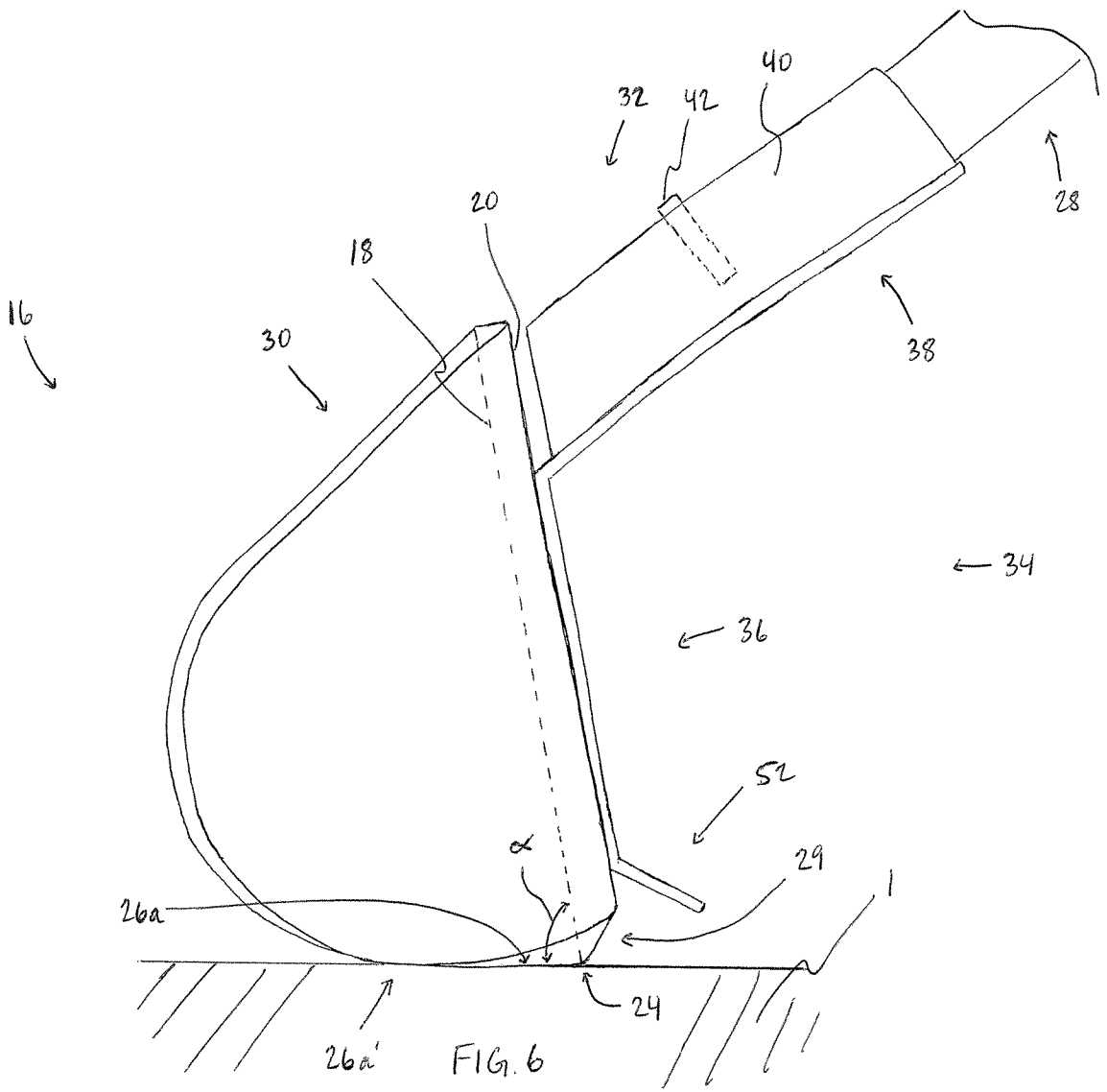
FIG. 6 is a side elevation view of the snow removal device in FIG. 1 in the forward inclined orientation.

As shown in FIG. 5 the linear portions 26*a* of the end portions' bottom edges 26 lie in a common plane with the main bottom edge 24.

Figure 3:
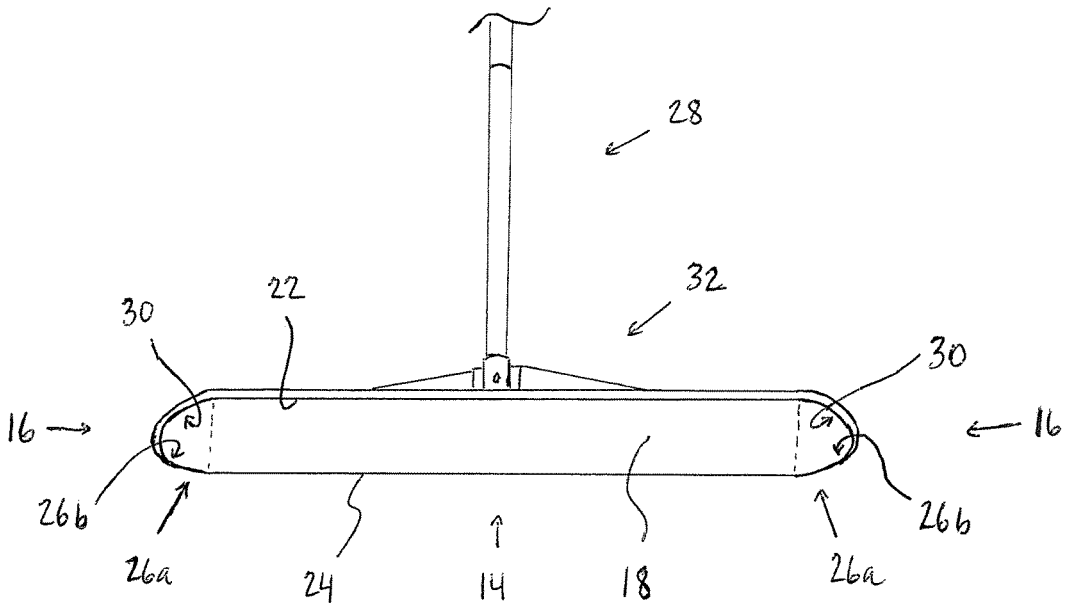
FIG. 3 is a front elevation view of the snow removal device in FIG. 1.
Figure 4:
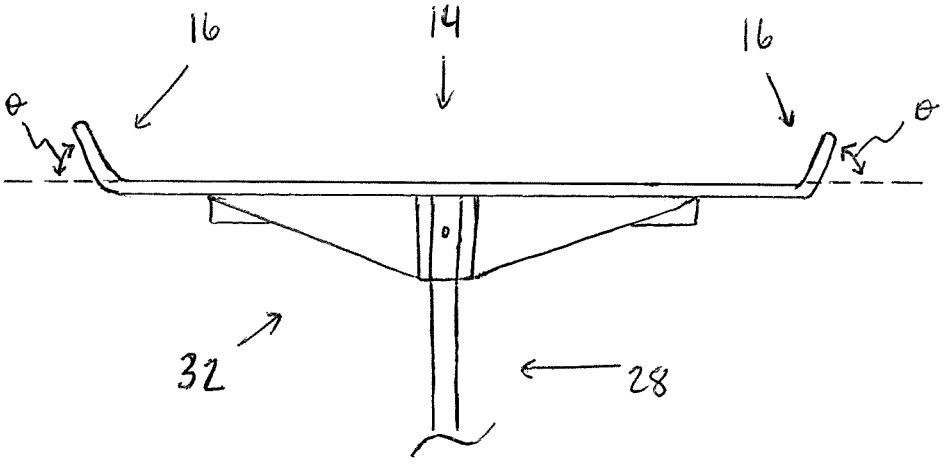
FIG. 4 is a top plan view of the snow removal device in FIG. 1.

Turning now to the end portions of the pushing element in more detail, the end portions also extend laterally outward from the main portion at a forward and lateral incline. Each one of the end portions are substantially planar and smooth. Each one of the end portions forms an angle "A" with the upright plane that is approximately 60 degrees in the illustrated embodiment. As in FIG. 5, the bottom edges 26 of the end portions have linear portions 26*a* between inner ends adjacent the main bottom edge 24 and forward-most edges 26*a*' so as to afford the pivotal motion from the normal working orientation to the forward inclined orientation. The linear portions of the bottom edges meet the main bottom edge at acute angles "α". As the main portion 14 is pivoted forward from the normal working orientation in FIG. 3 to the forward inclined orientation in FIG. 6, the bottom edges of the end portions engage the flat surface 1 at a forward-most inclined orientation which is limited by "α". The smaller the "α", then the further forward the main portion may be pivoted. In addition, the bottom edges 26 of the end portions are curved upwardly and forwardly from the linear portions thereof such that at least a portion 26*b* of each one of the bottom edges is convex.

Top edges 30 of the end portions extend downwardly and forwardly from the main top edge such that the top edges are convex like the portions of the bottom edges forward and above the linear portions thereof. In the illustrated embodiment, the top edges of the end portions meet the front surface of the main portion at an acute angle which is less than "α".

In general, the pushing element is symmetrical about an upright plane at right angles to a lateral midpoint of the pushing element. The main portion of the pushing element has a planar front surface terminating at a bottom edge spanning in the lateral direction so as to define an upright plane containing the bottom edge and so as to define a normal plane that is perpendicular to the upright plane of the main portion and that contains the bottom edge of the main portion in which the normal plane is effectively represented by the upper surface of the ground 1 in the orientation shown in FIG. 5. When the end portions on laterally opposite sides of the main portion have planar upright front surfaces extending laterally outwardly from opposing ends of the front surface of the main portion which are continuous with the front surface of the main portion and terminate at a respective bottom edge which is continuous with the bottom edge of the front surface of the main portion, and the front surface of each end portion is oriented transversely at a first angle relative to the upright plane of the front surface of the main portion such that the front surfaces of the end portions project forwardly from the upright plane in a laterally diverging relation to one another, the bottom edges of the end portions effectively lie at a compound angle to the bottom edge of the main portion as shown in the accompanying Figures. More particularly, the bottom edge of each end portion is oriented at a compound angle relative to the bottom edge of the main portion in which the compound angle is a combination of a first component defined by a first angle between the end portions and the upright plane of the main portion and a second component defined by a second angle between the bottom edges of the end portions and the normal plane.

Referring back to FIG. 5, further to the pushing element and the handle the snow removal device includes a coupler 32 arranged for coupling the pushing element and handle. The coupler comprises a bracket plate 34. The bracket plate is a single sheet of metal comprising three portions formed by folding the single sheet of metal twice. Firstly, the bracket plate has a main bracket portion 36 which is flush with the rear surface 20 of the main portion of the pushing element. The main bracket portion is generally rectangular and spans horizontally across a substantial portion the rear surface. The main bracket portion is screwed to the pushing element in the preferred embodiment.

The bracket plate also has an upper bracket portion 38. The upper bracket portion extends rearwardly and upwardly at an incline from the main bracket portion along a top thereof. The upper bracket portion is spaced below the main top edge 24. The upper bracket portion forms an angle with the rear surface of the main portion that is approximately 60 degrees in the illustrated embodiment; however, in other embodiments the angle between the upper bracket portion and the rear surface may lie in a range from 40 to 70 degrees and function similarly to the illustrated embodiment. The handle 28 is mounted onto the upper bracket portion along a lateral midpoint thereof with a longitudinally elongate C-channel-like bracket which defines a tubular collar 40 collectively with the upper bracket portion. The elongate bracket is supported on the upper bracket portion and oriented longitudinally along same. A first end of the handle is slidably received in the tubular collar 40 and locked therein by a pin 42 such that the handle is removable from within the tubular collar for packaging when shipping. A second end of the handle that is opposite the first end thereof has a grip 44 arranged for grasping by a user that is shown. Furthermore, the handle comprises a plurality of telescopic elements 46. The telescopic elements are elongate and arranged to be slidable relative to one another in a telescoping configuration such that some of the telescopic elements are received inside one another for adjusting a longitudinal length of the handle. More particularly, in the illustrated embodiment a first telescopic element defining the first end of the handle is received in a second telescopic element adjacent the first telescopic element. The second telescopic element defines the second end of the handle having the grip.

With the handle centrally mounted on the upper bracket portion of the bracket plate, laterally opposing portions of the upper bracket portion define a pair of gusset plates 48. The gusset plates are triangular in shape. Each gusset plate has a rear edge 50 which extends between an outer end of the tubular collar, which is opposite the rear surface of the main portion, and the rear surface of the main portion. As such, the gusset plates extend rearwardly from the pushing element for generally strengthening the coupler.

The snow removal device also has a scraping flange 52 which is integral with the bracket plate of the coupler. As such, the scraping flange is defined by a lower elongate portion of the bracket plate 34 that is below the main bracket portion. The lower elongate portion is folded rearwardly outward so as to form an angle with the rear surface 20 of the main portion that is approximately 60 degrees in the preferred embodiment; however, in other embodiments the angle between the lower elongate portion and the rear surface may lie in a range from 45 to 80 degrees and function similarly to the illustrated embodiment. In general, the scraping flange extends rearwardly and downwardly from the rear surface of the main portion so as to be oriented at a decline therefrom. The scraping flange spans horizontally along a full lateral width of the bracket plate. A coupled portion 54 of the scraping flange, where the scraping flange meets the main bracket portion along the lateral width thereof, is spaced above the main bottom edge 24 so as to be closer thereto than to the main top edge 22. The scraping flange also has a scraping edge 56 at a free end of the scraping flange that is opposite the coupled portion thereof. The scraping edge is located at a spaced distance rearward of the rear surface 20 of the main portion. The scraping flange is arranged to engage the flat surface 1 when the main portion is pivoted rearwardly about its main bottom edge as in FIG. 7. As such, the scraping edge is spaced above the flat surface when the main portion is in the normal working orientation as shown in FIG. 5.

In use, the snow removal device is positioned such that the main bottom edge 24 is engaging the flat surface 1 as in FIG. 5. The snow removal device is then moved along the flat surface in the sliding motion with the main portion 14 oriented in the normal working orientation. As such, the front surface 18 of the main portion pushes the snow in the forwardly direction. Furthermore, the end portions 16 help the snow to gather in front of the main portion of the pushing element. If a rigid spot of snow is encountered while sliding the pushing element along the ground causing the main portion to tend to pivot forward thereabout, the main portion may pivot forward about the main bottom edge 24 as the user continues to move forwardly without lifting the main bottom edge. As such, the user does not necessarily have to stop and readjust the pushing element 12 before attempting to clear the rigid spot again especially because the main bottom edge lifted off the ground as the main portion pivoted forward, due to shapes of the end portions. Consequently, a process of clearing snow may become quicker and less tiring without additional need for readjusting the main portion due to contacting rigid spots on the flat surface that effect lifting of the main bottom edge from the flat surface. Additionally, rigid mounting of the handle 28 to the coupler 32 may allow pressure of the main bottom edge along the flat surface to at least be maintained in between the normal working and forward inclined orientations.

Figure 7:
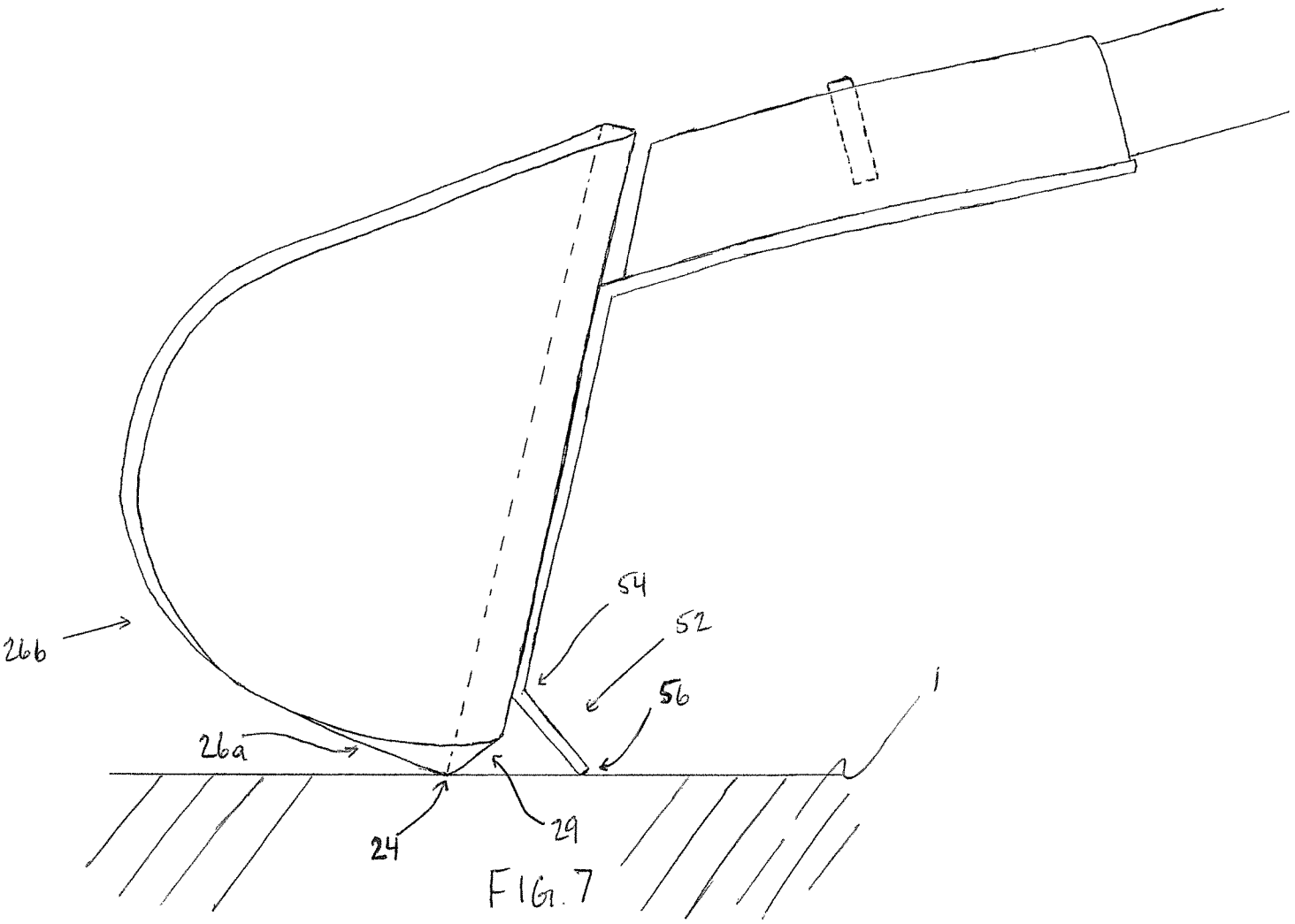
FIG. 7 is a side elevation view of the snow removal device in FIG. 1 pivoted rearwardly.

For scraping ice or more densely packed snow that cannot entirely be cleared with the front surface 18 and main bottom edge 24 of the pushing element, the main portion of the pushing element is pivoted about its main bottom edge so as to engage the flat surface with the scraping edge 56 of the scraping flange as in FIG. 7. Once the scraping edge is engaging the ground, the scraping flange is moved rearwardly along the flat surface 1. As such, both functions of a scraper and snow pusher are incorporated in a single snow removal device.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A snow removal device for clearing snow from a ground surface comprising:

a pushing element which is elongate in a lateral direction crosswise to a forward direction in which the pushing element is displaceable relative to the ground surface to push the snow, the pushing element having a main portion and laterally opposite end portions;

a handle extending rearwardly from the main portion;

the main portion of the pushing element having a planar front surface terminating at a bottom edge spanning in the lateral direction so as to define an upright plane containing the bottom edge therein for engaging the ground surface;

the end portions on laterally opposite sides of the main portion having planar upright front surfaces extending laterally outwardly from opposing ends of the front surface of the main portion;

the front surface of each end portion being continuous with the front surface of the main portion and terminating at a respective bottom edge which is continuous with the bottom edge of the front surface of the main portion;

the front surface of each end portion being oriented transversely at a first angle relative to the upright plane of the front surface of the main portion such that the front surfaces of the end portions project forwardly from the upright plane in a laterally diverging relation to one another; and the bottom edges of the end portions and the bottom edge of the main portion lying in a common plane with one another in which the common plane is oriented at approximately 80 degrees to the upright plane of the main portion such that the bottom edges of the end portions are inclined at a second angle relative to a normal plane that is perpendicular to the upright plane of the main portion and that contains the bottom edge of the main portion;

whereby the bottom edge of each end portion is oriented at a compound angle relative to the bottom edge of the main portion, the compound angle being a combination of a first component defined by said first angle between the end portions and the upright plane of the main portion and a second component defined by said second angle between the bottom edges of the end portions and the normal plane.

2. The snow removal device according to claim 1, wherein the upright plane comprises a majority of the front surface.

3. The snow removal device according to claim 1 further comprising a scraping element extending rearwardly from the rear surface of the main portion, the scraping element having a scraping edge at a free end of the scraping element that is located at a spaced distance rearward of the rear surface of the main portion.

4. The snow removal device according to claim 3, wherein the scraping element also extends downwardly from the rear surface at a location spaced above the bottom edge of the main portion such that the scraping element is oriented at a decline from the rear surface.

5. The snow removal device according to claim 3, wherein the scraping element is elongate and spans horizontally along a substantial portion of the main portion of the pushing element.

6. The snow removal device according to claim 3, wherein the scraping element is a flange.

7. The snow removal device according to claim 3 further comprising a coupler arranged for coupling the pushing element and handle, the coupler comprising a bracket plate, and the scraping element being integral with the bracket plate.

8. The snow removal device according to claim 3, wherein the scraping edge is spaced upwardly from the bottom edge in a direction within the upright plane from the bottom edge of the main portion to the top edge of the main portion so that the scraping edge is arranged to contact the ground surface when the pushing element is pivoted rearwardly about the bottom edge of the main portion to orient the upright plane in a rearward incline but not to contact the ground surface in the normal working orientation in which the upright plane is substantially perpendicular to the flat surface.

9. The snow removal device according to claim 1 further comprising a coupler arranged for coupling the pushing element and handle, the coupler comprising gusset plates on laterally opposing sides of the handle between the handle and the pushing element, the gusset plates extending rearwardly from the pushing element for strengthening the coupler.

10. The snow removal device according to claim 1, wherein the handle comprises a plurality of telescopic elements which are elongate and arranged to be slidable relative to one another in a telescoping configuration for adjusting a length of the handle, and the handle is coupled to the pushing element such that the handle is removable therefrom for packaging when shipping.

* * * * *